US006402375B1

(12) United States Patent
Schreiter et al.

(10) Patent No.: US 6,402,375 B1
(45) Date of Patent: Jun. 11, 2002

(54) RESEALABLE CLOSURE MECHANISM HAVING A SLIDER DEVICE

(75) Inventors: Michael E. Schreiter; Mladomir Tomic, both of Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 31 days.

(21) Appl. No.: 09/714,414

(22) Filed: Nov. 16, 2000

Related U.S. Application Data

(60) Provisional application No. 60/202,443, filed on May 8, 2000.

(51) Int. Cl.[7] ..... B65D 33/24
(52) U.S. Cl. ..... 383/64; 24/400; 24/427
(58) Field of Search ..... 383/64; 24/399, 24/400, 427, 430

(56) References Cited

U.S. PATENT DOCUMENTS

| | | | | | |
|---|---|---|---|---|---|
| 3,122,807 | A | | 3/1964 | Ausnit | |
| 3,173,184 | A | | 3/1965 | Ausnit | |
| 3,220,076 | A | | 11/1965 | Ausnit et al. | |
| 3,230,593 | A | | 1/1966 | Herz | |
| 3,324,520 | A | | 6/1967 | Ausnit | |
| 3,426,396 | A | | 2/1969 | Laguerre | |
| 3,579,747 | A | * | 5/1971 | Hawley | 24/400 |
| 3,660,875 | A | * | 5/1972 | Gutman | 24/399 |
| 4,262,395 | A | | 4/1981 | Kosky | |
| 5,007,143 | A | | 4/1991 | Herrington | |
| 5,010,627 | A | | 4/1991 | Herrington et al. | |
| 5,020,194 | A | | 6/1991 | Herrington et al. | |
| 5,063,644 | A | | 11/1991 | Herrington et al. | |
| 5,067,208 | A | | 11/1991 | Herrington, Jr. et al. | |
| 5,070,583 | A | | 12/1991 | Herrington | |
| 5,301,394 | A | * | 4/1994 | Richardson et al. | 24/399 |
| 5,426,830 | A | * | 6/1995 | Richardson et al. | 24/430 |
| 5,442,838 | A | | 8/1995 | Richardson et al. | |
| 5,722,128 | A | | 3/1998 | Toney et al. | |
| 5,809,621 | A | | 9/1998 | McCree et al. | |
| 5,836,056 | A | | 11/1998 | Porchia et al. | |
| 5,867,875 | A | * | 2/1999 | Beck et al. | 24/400 |
| 6,014,795 | A | | 1/2000 | McMahon et al. | |
| 6,047,450 | A | | 4/2000 | Machacek et al. | |
| 6,088,887 | A | * | 7/2000 | Bois | 24/399 |
| 6,220,754 | B1 | * | 4/2001 | Stiglic et al. | 383/64 |

* cited by examiner

*Primary Examiner*—Stephen P. Garbe

(57) ABSTRACT

A slider device includes a top wall, first and second sidewalls, and a separating structure. The first sidewall depends from the top wall and includes a first hooking construction. The second sidewall also depends from the top wall and includes a second hooking construction. The top wall and first and second sidewalls define a first cavity that operably receives a closure mechanism having first and second selectively engageable closure profiles. The separating structure selectively separates the first and second profiles of the closure mechanism. The separating structure includes a stabilizer and a separator. The stabilizer extends from the second sidewall and the second hooking construction into the first cavity. The stabilizer retains a lower portion of the second closure profile proximate to a lower portion of the first closure profile. The separator depends from the top wall and extends from the first sidewall into the first cavity. The separator applies pressure to an upper portion of the second closure profile to push the upper portion of the second closure profile away from an upper portion of the first closure profile, causing the first and second closure profiles to separate.

21 Claims, 4 Drawing Sheets

RESEALABLE CLOSURE MECHANISM HAVING A SLIDER DEVICE

Priority under 35 U.S.C. § 119(e) is claimed to provisional application Ser. No. 60/202,443, filed on May 8, 2000, and entitled "Resealable Closure Mechanism Having a Slider Device". The complete disclosure of application Ser. No. 60/202,443 is incorporated by reference herein.

FIELD

This disclosure generally relates to resealable closure arrangements for packages, such as, plastic bags. In particular, the present invention relates to resealable closure mechanisms or zipper-type closures opening and closing of which is facilitated with a slider device.

BACKGROUND

Many packaging applications use resealable containers to store various types of articles and materials. These packages may be used to store and ship food products, non-food consumer goods, medical supplies, waste materials, and many other articles. Resealable packages are convenient in that they include a reclosable or resealable closure construction that can be closed and resealed after the initial opening to preserve the enclosed contents. The need to locate a storage container for the unused portion of the products in the package is thus avoided. As such, providing products in resealable packages appreciably enhances the marketability of those products. Resealable containers, such as plastic bags, additionally are marketed specifically for the purpose of storing product that was not originally provided in a resealable or reclosable package.

The opening and closing of some types of resealable packages is facilitate by using a slider device mounted on the resealable closure construction. Generally, the resealable closure construction has interlocking closure profiles that mate to seal the package, and umnate to provide access to the interior of the package. The slider device typically includes a separator or plow-type structure at one end that unmates or pries apart the closure profiles when the slider device travels in a first direction along the closure construction. The sidewalls of the slider device are inwardly tapered from one end to the opposite end so that when the slider device is moved in a second, opposite direction, the sidewalls engage the closure profiles and progressively move them into engagement to close the resealable package.

Concerns are raised regarding resealable closure constructions with slider devices. One such concern is the installation of slider devices. Another concern is the plow design and the ability of the plow to effectively open the resealable closure construction. Another concern is containing product within the interior of the package. Therefore, improvements are desirable.

SUMMARY

In one aspect of the present disclosure, a slider device for use with a reclosable package is disclosed. The slider device includes a top wall, first and second sidewalls, and a separating structure. The first sidewall depends from the top wall and includes a first hooking construction. The second sidewall also depends from the top wall and includes a second hooking construction. The top wall and first and second sidewalls define a first cavity that operably receives a closure mechanism having first and second selectively engageable closure profiles. The separating structure selectively separates the first and second profiles of the closure mechanism.

The separating structure includes a stabilizer and a separator. The stabilizer extends from the second sidewall and the second hooking construction into the first cavity. The stabilizer retains a lower portion of the second closure profile in close contact with a lower portion of the first closure profile. The separator depends from the top wall and extends from the first sidewall into the first cavity. The separator applies pressure to an upper portion of the second closure profile to push the upper portion of the second closure profile away from an upper portion of the first closure profile, causing the first and second closure profiles to separate.

In another aspect, the present disclosure involves a closure arrangement for use with a resealable or reclosable package. The closure arrangement includes a closure mechanism having first and second closure profiles and a slider device. The slider device has structure analogous to the slider device previously described.

Another aspect involves a resealable package. The resealable package includes first and second panel sections joined together to define an enclosed region and a mouth that provides access to the enclosed region. The resealable package also includes a closure arrangement secured to the first and second panel sections for selectively opening and sealing the mouth. The closure arrangement h as structure analogous to the closure arrangement previously described.

Another aspect involves a method of opening a closure mechanism having first and second closure profiles. The method includes moving a slider device along the closure mechanism in a first direction; pushing a first portion of the first closure profile away from a first portion of the second closure profile; and retaining a second portion of the first closure profile proximate to a second portion of the second closure profile during said step of pushing The above summary of principles of the present invention is not intended to describe each illustrated embodiment or every implementation of the present invention. The figures and the detailed description that follow more particularly exemplify these embodiments.

DETAILED DESCRIPTION

Figure 1:
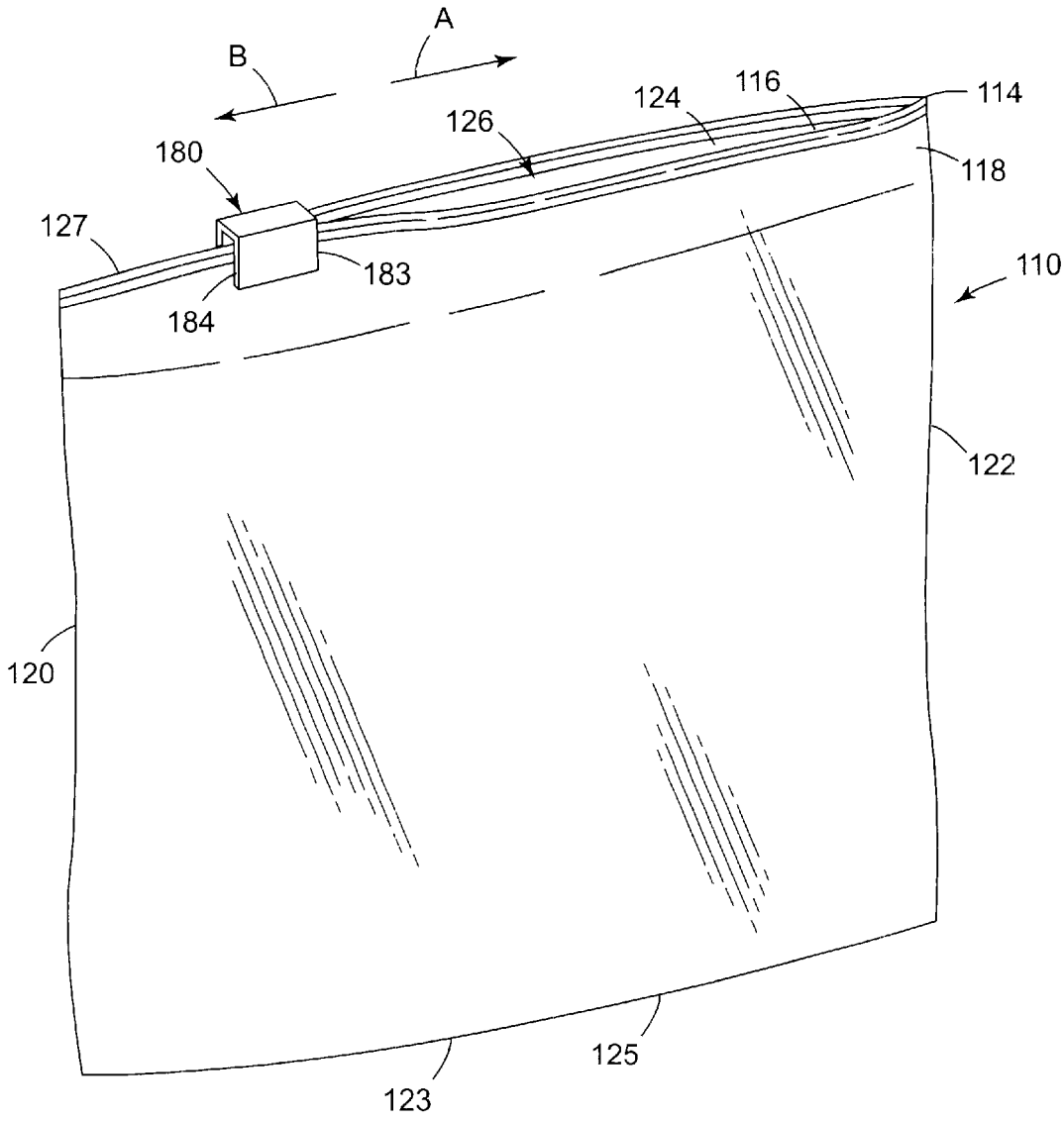
FIG. 1 is a perspective view of a flexible, resealable package having a slider device, according to an example embodiment of the present disclosure.

According to an example embodiment of the present disclosure, in general, a package includes a slider device and a closure mechanism. The slider device has a separating structure designed to effectively open and close the closure mechanism. FIG. 1 illustrates an example type of package 110 that benefits from the use of principles of this disclosure.

Attention is directed to FIG. 1, which illustrates an example packaging arrangement in the form of a resealable, flexible package 110, for example, a polymer package such as a plastic bag. The flexible package 110 includes first and second opposed panel sections 116, 118 which define the overall structure of flexible package 110. Panel sections 116, 118 are typically made from a flexible polymeric sheet, commonly known as a plastic film, although in some embodiments it may be desired to use a laminated material that includes a non-polymeric component, such as paper. In some manufacturing applications, the first and second panel sections 116, 118 are heat-sealed together along first and second side edges 120, 122 and meet at a fold line 123 in order to form a three-edged containment section for a product within an interior 124 of package 110. In the embodiment shown, fold line 123 is the bottom edge 125 of package 110. Alternatively, two separate panel sections 116, 118 of plastic film may be used and heat-sealed together along the two side edges 120, 122 and at bottom edge 125. In yet another embodiment, a single polymeric sheet is folded at one of side edges 120, 122, and heat-sealed along the other side edge and at bottom edge 125. In a further embodiment, a tube of material can be used; this would result in each of side edges 120, 122 being fold lines and bottom edge 125 being a heat-seal.

Flexible package 110 has a resealable closure mechanism 114, for example, interlocking profiled elements, constructed in accordance with principles of this disclosure, attached to first and second panel sections 116, 118. A mouth 126 at the top edge 127 of the package provides access to interior 124 of package 110. In the particular embodiment shown, mouth 126 extends the width of package 110. Alternatively, first closure mechanism 114 can be positioned on package 110 at a location different from mouth 126 of the package 110, depending on the application needs for package 110. For example, first closure mechanism 114 can be positioned in a side panel, such as panel 116.

Resealable closure mechanism 114 can be any one of a variety of closure mechanisms. In the particular embodiment illustrated in FIG. 2, resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
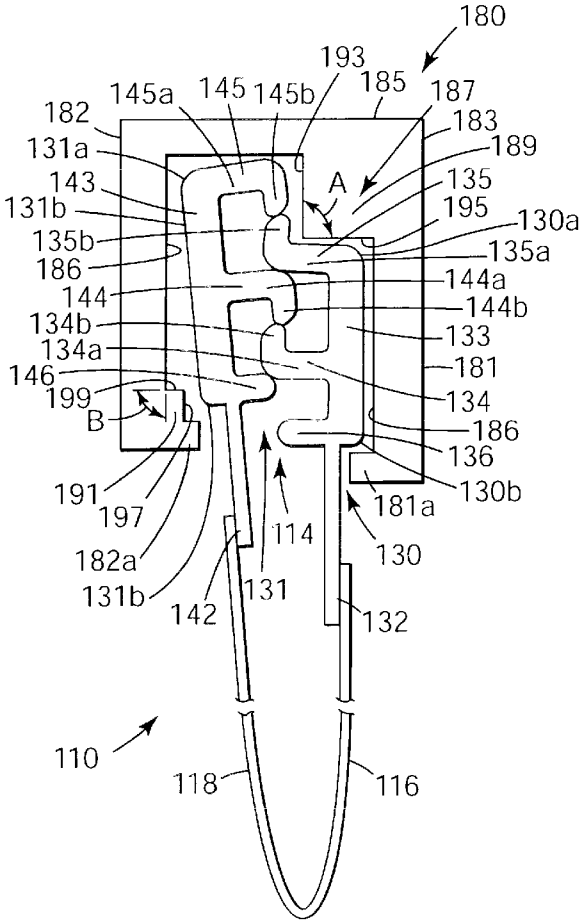
FIG. 2 is a fragmented, cross-sectional view of profiled elements secured to a flexible package and an end view of a slider device, according to an example embodiment of the present disclosure.

In particular, the zipper-type closure mechanism in FIG. 2 is an illustration of one example of a multi-track closure mechanism. By the term "multi-track," it is meant that each profile has a plurality of interlocking hooks or members for interlocking or engaging. The resealable closure mechanism 114 includes an elongated first closure profile 130 and an elongated second closure profile 131, which releasable interlock or engage.

Closure profiles 130, 131 can be manufactured separately from each other as two individual extrusions, or closure profiles 130, 131 can be extruded as a single structure that is subsequently slit. It is understood that although separately extruded, closure profiles 130, 131 can be simultaneously extruded through a single die with multiple orifices. The closure profiles 130, 131 can be produced immediately prior to incorporation into package 110, or closure profiles 130, 131 can be produced and then stored, either together or separately, until incorporated into package 110. Alternatively, any simple or complex closure mechanism could be used, for example, a mono-track zipper-type closure mechanism.

Still in reference to FIG. 2, first closure profile 130 includes a first sealing flange or bonding strip 132, a first base strip 133, a first closure member 134, a second closure member 135, and a first guide post 136. When first closure profile 130 is interlocked or engaged with second closure profile 131, first closure member 134 extends from first base strip 133 toward second closure profile 131 and is generally projecting from first base strip 133. The first closure member 134 includes a first post 134*a* and a first hook 134*b*. In the embodiment illustrated, first post 134*a* generally extends or projects from first base strip 133, and first hook 134*b* generally extends or projects from the first post 134*a*.

Likewise, second closure member 135 extends from first base strip 133 toward second closure profile 131 and is generally projecting from first base strip 133. Second closure member 135 includes a second post 135*a* and a second hook 135*b*. In the embodiment illustrated, second post 135*a* generally extends or projects from first base strip 133, and second hook 135*b* generally extends or projects from second post 135*a*.

First guide post 136 of first closure profile 130 also extends from first base strip 133 toward second closure profile 131 and is generally projecting from first base strip 133. First guide post 136 aids in aligning first closure profile 130 for interlocking as will be explained in more detail below. Preferably, first bonding strip 132 depends or extends downward from first guide post 136 and is typically attached to a package wall, such as first panel section 116 of package 110.

Second closure profile 131 likewise includes a second sealing flange or bonding strip 142, a second base strip 143, a third closure member 144, a fourth closure member 145, and a second guide post 146. When second closure profile 131 is interlocked or engaged with first closure profile 130, third closure member 144 extends from second base strip 143 toward first closure profile 130 and is generally projecting from second base strip 143. Third closure member 144 includes a third post 144*a* and a third hook 144*b*. In the embodiment illustrated, third post 144*a* generally extends or projects from second base strip 143, and third hook 144*b* generally extends or projects from second post 144*a*.

Likewise, fourth closure member 145 extends from second base strip 143 toward first closure profile 130 and is generally projecting from second base strip 143. Fourth closure member 145 includes a fourth post 145*a* and a fourth hook 145*b*. In the embodiment illustrated, fourth post 145*a* generally extends or projects from second base strip 143, and fourth hook 145*b* generally extends or projects from fourth post 145*a*.

Second guide post 146 also extends from second base strip 143 toward first closure profile 130 and is generally projecting from second base strip 143. Second guide post 146 aids in aligning second closure profile 131 for interlocking as will be explained in more detail below. Preferably, second bonding strip 142 depends or extends downward from second guide post 146 and is typically attached to a package wall, such as second panel section 118 of package 110.

First and second closure profiles 130, 131 are designed and constructed to engage with one another to form resealable closure mechanism 114. First closure member 134 and second closure member 135 of first closure profile 130 extend from first base strip 133 a certain distance, which may be the same or a different distance for first closure member 134 than second closure member 135. Third closure member 144 and fourth closure member 145 of second closure profile 131 also extend from second base strip 143 a certain distance, which may be the same or different for third closure member 144 and fourth closure member 145. These certain distances, that closure members 134, 135 144, 145 extend, are sufficient to allow mechanical engagement, or interlocking, between first closure member 134 of first closure profile 130 and third closure member 144 of second closure profile 131, and mechanical engagement between second closure member 135 of first closure profile 130 and fourth closure member 145 of second closure profile 131.

In particular, first hook 134*b* of first closure member 134 engages or interlocks with third hook 144*b* of third closure member 144, and second hook 135*b* of first closure member 135 engages or interlocks with fourth hook 145*b* of fourth closure member 145. First guide post 136 of first closure profile 130 and second guide post 146 of second closure profile 131 aid in aligning closure profiles 130, 131 and in keeping the closure profiles 130, 131 interlocked. Guide posts 136, 146 also extend from first and second base strip 133, 143 a certain distance, which may be greater or less than the distances that closure members 134, 135 144, 145 extend. To further aid in aligning closure profiles 130, 131 for interlocking, closure profiles 130, 131 are generally sealed to one another at their ends, such as side edges 120, 122 of FIG. 1. Pressure is applied to at least one of closure profiles 130, 131 as closure profiles 130, 131 engage to form openable sealed closure mechanism 114. Pulling or pushing first closure profile 130 and second closure profile 131 away from each other causes the two closure profiles 130, 131 to disengage, thus opening package 110 of FIG. 1. This provides access to the contents of package 110 through mouth 126, FIG. 1.

In some applications, closure profiles 130, 131 are formed by two separate extrusions or through two separate openings of the common extrusion. Typically, the resealable closure mechanism 114 is made of a polymeric material, such as polyethylene or polypropylene. In one example embodiment, the closure arrangement illustrated in FIG. 2 is manufactured using conventional extrusion and heat sealing techniques.

Referring to FIGS. 1 and 2, a slider device 180 is mounted on resealable closure mechanism 114 to selectively open and close resealable closure mechanism 114 by unmating and mating first and second closure profiles 130, 131. Slider device 180 has first end 183 and second opposite end 184. As mounted in FIG. 1, first end 183 is the leading end when slider device 180 is moved in first sealing direction "A" to mate closure profiles 130, 131 and second end 184 is the trailing end. When moved in second direction "B" to unmate closure profiles 130, 131, second end 184 is the leading end and first end 183 is the trailing end.

Figure 3:
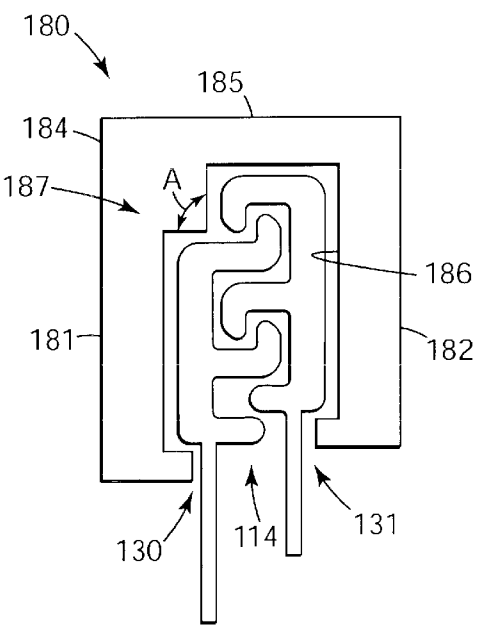
FIG. 3 is a fragmented, cross-sectional view of the profiled elements and the slider device of FIG. 2, except that the view of slider device is taken from an end opposite that of FIG. 2.

Attention is directed to FIGS. 2 and 3; FIG. 2 is an end elevational view of slider device 180 showing first end 183 of slider device 180 and FIG. 3 is a view of opposite second end 184. Slider device 180 has first and second sidewalls 181, 182, and a top wall 185 extending between first and second sidewalls 181, 182 from first end 183 to second end 184. Preferably, top wall 185 is rigid. By the term "rigid," it is meant that top wall 185 is stiff and relatively inflexible. Sidewalls 181, 182, together with top wall 185, define a first cavity 186 that slideably receives first and second closure profiles 130, 131.

First sidewall 181 of slider device 180 includes a first hooking construction 181*a*. First hooking construction 181*a* is designed and constructed to retain slider device 180 on resealable closure mechanism 114. In particular, first hooking construction 181*a* is designed and constructed to fit under, or hook over, first base strip 133, preventing the upward movement of slider device 180 after installation. Likewise, second sidewall 182 includes a second hooking construction 182*a*. Second hooking construction 182*a* is designed and constructed to retain slider device 180 on resealable closure mechanism 114. In particular, second hooking construction 182*a* is designed and constructed to fit under, or hook over, second base strip 143, preventing the upward movement of slider device 180 after installation.

Slider device 180 further includes a separating structure 187, illustrated in FIG. 2. Separating structure 187 is designed and constructed to selectively separate first and second closure profiles 130, 131 to provide access to interior 124 of the package of FIG. 1. In the embodiment shown in FIG. 2, separating structure 187 includes the combination of a separator 189 and a stabilizer 191 positioned generally opposite from separator 189. Separator 189 is designed and constructed to push a top portion 131*a* of second closure profile 131 away from a top portion 130*a* of first closure profile 130. Specifically, separator 189 is designed and constructed to disengage and push fourth interlocking member 145 away from second interlocking member 135. Stabilizer 191 is designed and constructed to retain a lower portion 131*b* of second closure profile 131 in relative position to a lower potion 130*b* of first closure profile 130. Specifically, stabilizer 191 is designed and constructed to prevent relative separation of first and second bonding strips 132, 142. Together, separating structure 187 applies torque to second closure profile 131, causing second closure profile 131 to separate from first closure profile 130.

Separator 189 depends or extends down from top wall 185 and projects or extends out from first sidewall 181 into first cavity 186. In the embodiment illustrated, the separator 187 has a first edge 193 that depends down from top wall 185 and a second edge 195 that projects out from first side wall 181. First and second edges 193, 195 define an angle A between them. Preferably, angle A is at least 45 degrees, most preferably greater than 70 degrees, and typically about 90 degrees.

Separator 189 depends from top wall 185 a first certain distance and projects from first sidewall 181 a second certain distance. These certain distances are sufficient to allow separator 189 to push second closure profile 131 away from first closure profile 130, causing disengagement or separation of first and second closure profiles 130, 131. In particular, first edge 193 presses against hook 145*b* of fourth closure member 145 to dislodge it from hook 135*b* of second closure member 135. These certain distances vary as one progresses from first end 183 of slider device 180 to second end 184, as will be described in detail below. FIG. 2 illustrates first and second closure profiles 130, 131 opened as the separator 189 is proximate the upper portion 130*a* of the first closure profile 130.

Stabilizer 191 projects or extends up from second hooking construction 182*a* and projects or extends from second sidewall 182 into first cavity 186. In the embodiment illustrated, stabilizer 191 has a first edge 197 that extends up from second hooking construction 182*a* and a second edge 199 that projects from second side wall 182 into cavity 186. First and second edges 197, 199 define an angle B between them. Preferably, angle B is at least 45 degrees, most preferably greater than 70 degrees, and typically about 90 degrees.

Stabilizer 191 extends up from first hooking construction 182*a* a third certain distance and projects from second sidewall 182 a fourth certain distance. These certain distances are sufficient to allow stabilizer 191 to retain lower portion 131*b* of second closure profile 131 relative to lower portion 130*b* of first closure profile 130, while separator 189 unhooks and separates first and second closure profiles 130, 131.

Figure 4:
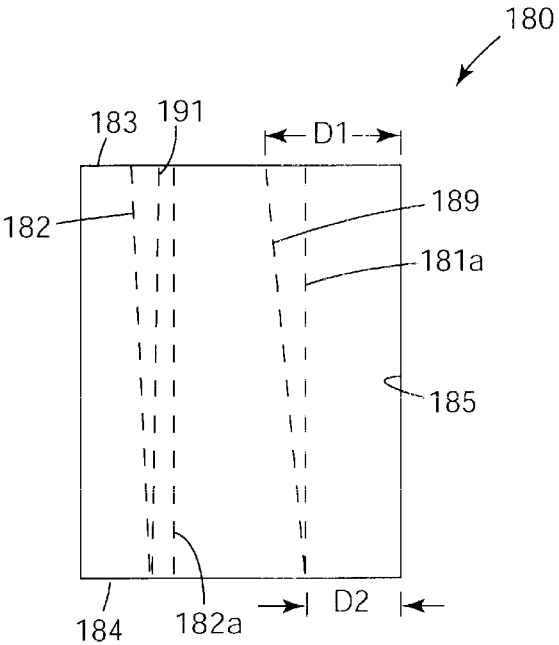
FIG. 4 is a top plan view of the slider device of FIGS. 2 and 3.

In preferred embodiments, separator 189 is largest at first end 183 of slider device 180, as illustrated in FIG. 2, and tapers toward second end 184 of slider device 180, which is shown in FIG. 3. Referring to FIG. 4, which is a plan view of top wall 185 of slider device 180, separator 189 extends a first distance D1 into first cavity 186 at first end 183, and extends a second distance D2 into first cavity 186 at second 184. Typically, second distance D2 is less than first distance D1 by at least 10%. These distances D1 and D2 may be either or both of first edge 193 and second edge 195.

In preferred embodiments, a thickness of the second sidewall 182 tapers from a thicker second sidewall 182 at second end 184 to a relatively thinner second sidewall 182 at first end 183 of slider device 180. In other words, the thickness of the second sidewall 182 is greater at second end 184 than at first end 183 of slider device 180. In the particular embodiment illustrated in FIG. 3, which shows slider device 180 viewed from second end 184, second sidewall 182 has the same thickness as stabilizer 191 of FIG. 2, so that second sidewall 182 and stabilizer 191 are indistinguishable in FIG. 3. FIG. 4 illustrates the tapering of the thickness of second sidewall 182 of the slider device 180. As can be seen, fourth edge 199 approaches being non-existent at second end 184; at this point, second sidewall 182 is at its maximum thickness.

As the thickness of second sidewall 182 increases from first end 183 to second end 184 of slider device 180, second sidewall 182 applies pressure to second closure profile 131 pushing it toward first closure profile 130. This pressure causes first and second closure profiles 130, 131 to mechanically engage or interlock. FIG. 3 illustrates the first and second closure profiles 130, 131 interlocked with second sidewall 182 in close proximity to second closure profile 131.

Thus, referring back to FIG. 1, when the slider device 180 is moved in a first, sealing direction A along top edge 127 of package 110, the tapered thickness of second sidewall 182, as seen in FIGS. 2, 3 and 4, applies pressure to second closure profile 131, pinching together first and second closure profiles 130, 131 behind slider device 180 as slider device 180 moves in the first sealing direction A. Interlocked closure profiles 130, 131 seal mouth 126, preventing the contents of package 110 from spilling out.

Separating structure 187 (FIG. 2) separates closure profiles 130, 131 (FIG. 2) when the slider device 180 is moved in a second, opposite, direction B along top edge 127 of package 110. Separator 189 forces upper portion 131 a of second closure profile 131 away from upper portion 130*a* of first closure profile 130, while stabilizer 191 retains lower portion 131*b* of second closure profile 131 proximate to lower portion 130*b* of first closure profile 130. Separating first and second closure profiles 130, 131 provides access to the contents of package 110 through mouth 126.

Still in reference to FIG. 1, generally, to seal package 110, a package user slides slider device 180 in the sealing direction A along resealable closure mechanism 114. The tapered thickness second sidewall 182 (FIGS. 2, 3 and 4) applies pressure to second closure profile 131 thereby interlocking first and second closure profiles 130, 131 as slider device 180 travels in the scaling direction A. When slider device 180 is at or close to side edge 122, mouth 126 of package 110 is sealed closed. Generally to open package 110, the user moves slider device 180 in the opposite, opening direction B. Separating structure 187 (FIGS. 2, 3 and 4) separates first and second closure profiles 130, 131, opening the resealable closure mechanism 114.

Slider device 180 of the present disclosure has advantages over conventional slider devices. One advantage is that with slider device 180, closure profiles 130, 131 are substantially engaged along their entire length because slider device 180 does not have a plow (i.e., the slider device 180 is a "plow-free" or "plowless" slider device 180) wedged between first and second closure profiles 130, 131 preventing them from closing completely. This helps to prevent leaking when mouth 126 is closed.

Figure 5:
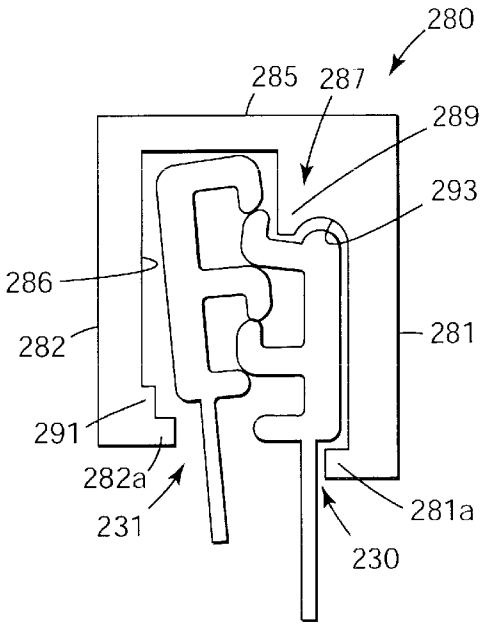
FIG. 5 is a fragmented, cross-sectional view of profiled elements and an end view of another embodiment of a slider device, similar to the view of FIG. 2, according to an example embodiment of the present disclosure.

Attention is directed to FIG. 5. FIG. 5 illustrates a second embodiment of a slider device 280. Slider device 280 has first and second sidewalls 281, 282 and a rigid top wall 285 extending between first and second sidewalls 281, 282 from a first slider end (not shown) to a second slider end (not shown). Sidewalls 281, 282, together with top wall 285, define a first cavity 286 that receives first and second closure profiles 230, 231.

Similar to slider device 180, first sidewall 281 includes a first hooking construction 281*a* and second sidewall 282 includes a second hooking construction 282*a*. Slider device 280 further includes a separating structure 287. In the embodiment shown, separating structure 287 includes a separator 289 and a stabilizer 291. In this embodiment, separator 289 defines a second cavity 293. Second cavity 293 is designed and constructed to receive, or capture, the first closure profile 230; first closure profile 230 includes a feature designed to be captured by second cavity 293. Capturing first closure profile 230 further aids in separating first and second closure profiles 230, 231 by preventing first closure profile 230 from moving when separator 289 applies pressure to second closure profile 231.

With the exception of second cavity 293, slider device 280 has structure analogous to slider device 180 of FIG. 2. For example, second sidewall 282 tapers from its second end to the first end.

Figure 6:
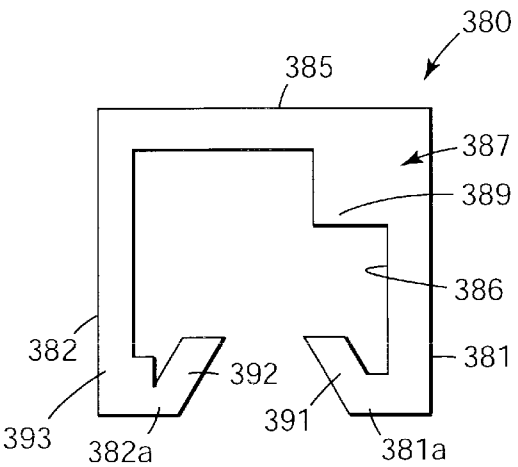
FIG. 6 is an end view of a slider device, according to another example embodiment of the present disclosure.

Referring now to FIG. 6, a third embodiment of a slider device 380 is illustrated. Slider device 380 has first and second sidewalls 381, 382, and a rigid top wall 385 extending between first and second sidewalls 381, 382. Sidewalls 381, 382, together with top wall 385, define a first cavity 386 that receives the closure profiles (not shown).

First sidewall 381 includes a first hooking construction 381*a* and second sidewall 382 includes a second hooking construction 382*a*. Slider device 280 further includes a separating structure 387, which includes a separator 389 and a stabilizer 393.

In this embodiment, slider device 380 includes a first retention wing 391 extending from first hooking construction 381*a* of first sidewall 381. Slider device 380 also includes a second retention wing 392 extending from second hooking construction 382*a* of second sidewall 382. Retention wings 391, 392 aid in retention of slider device 380 on the resealable closure mechanism, and aid in positioning the closure profiles for separating and engaging. Retention wings 391, 392 also aid in mounting slider device 380 onto the resealable closure mechanism.

Figure 7:
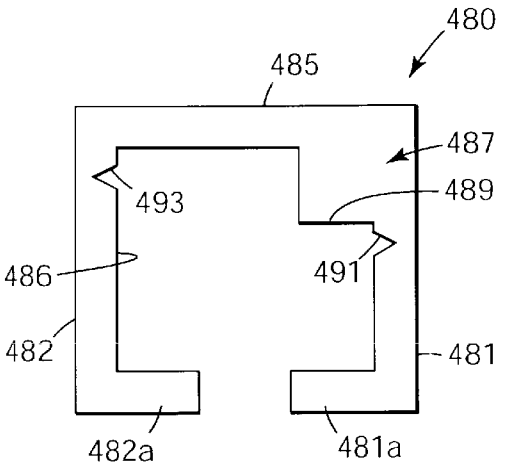
FIG. 7 is an end view of a slider device, according to another example embodiment of the present disclosure.

Attention is directed to FIG. 7, which illustrates a fourth embodiment of a slider device 480. Similar to the previously described embodiments, slider device 480 has first and second sidewalls 481, 482, and a rigid top wall 485 extending between first and second sidewalls 481, 482. Sidewalls 481, 482 define a first cavity 486 that receives the closure profiles (not shown).

First sidewall 481 includes a first hooking construction 481*a*and second sidewall 482 includes a second hooking construction 482*a*. Slider device 480 further includes a separating structure 487, which includes a separator 489. In this embodiment, first sidewall 481 defines a first notch 491 in an interior surface of sidewall 481. Likewise, the second sidewall 482 defines a second notch 493 in an interior surface of sidewall 482. First and second notches 491, 493 are designed and constructed to allow first and second sidewalls 481, 482, respectively, to flex outward away from each other during installation of slider device 480 onto resealable closure mechanism 114 (FIG. 1). Thus, as slider device 480 is pushed onto resealable closure mechanism 114, sidewalls 481, 482 flex outward away from each other until slider device 480 is positioned over the closure profiles of resealable closure mechanism 114. Sidewalls 481, 482 snap back in and hooking constructions 481*a*, 482*a* retain slider device 480 on package 110.

Figure 9:
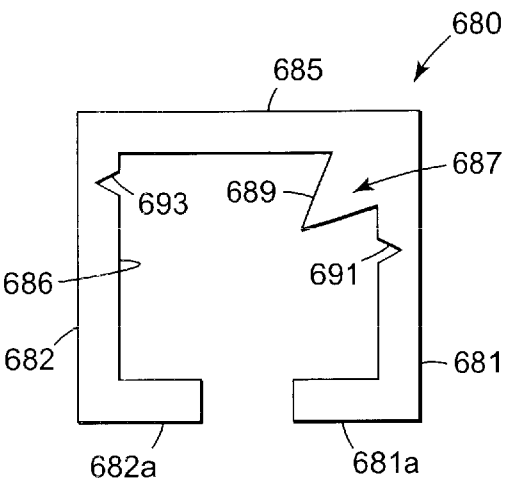
FIG. 9 is an end view of a slider device, according to yet another example embodiment of the present disclosure.
Figure 8:
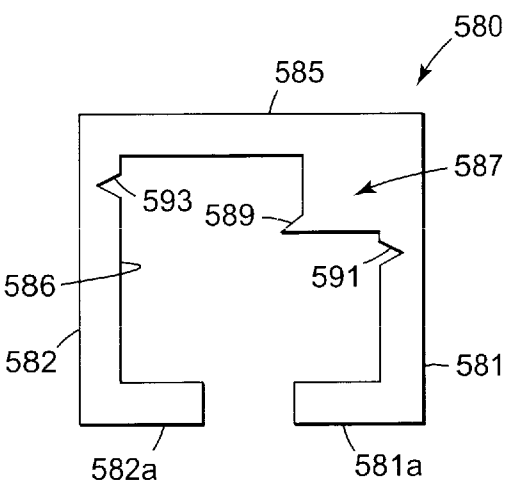
FIG. 8 is an end view of slider device, according to still another example embodiment of the present disclosure.

Variations of slider device 480 of FIG. 7 are shown in FIGS. 8 and 9. In FIG. 8, slider device 580 has first and second sidewalls 581, 582 having first and second interior notches 591, 593, and a rigid top wall 585 extending between first and second sidewalls 581, 582. Sidewalls 581, 582 define a first cavity 586 that receives the closure profiles (not shown). First sidewall 581 includes a first hooking construction 581*a* and second sidewall 582 includes a second hooking construction 582*a*. Slider device 580 further includes a separating structure 587, which is similar to separating structure 487 of FIG. 7, except that separating structure 587 has a separator 589 having a point or tip extending therefrom into cavity 586. Separator 589 is designed and constructed to provide increased pushing against the closure profiles (not shown) to facilitate their unmating.

Slider device 680 of FIG. 9 has first and second sidewalls 681, 682 having first and second interior notches 691, 693, and a rigid top wall 685 extending between first and second sidewalls 681, 682, which define a first cavity 686 that receives the closure profiles (not shown). First sidewall 681 includes a first hooking construction 681*a* and second sidewall 682 includes a second hooking construction 682*a*. Slider device 680 further includes a separating structure 687, which is similar to separating structure 487 of FIG. 7 and separating structure 587 of FIG. 8, except that separating structure 687 has a separator 689, the entire construction of which is angled to projected into cavity 686. Separator 689 is designed and constructed to provide increased pushing against the closure profiles (not shown) to facilitate their unmating.

Figure 10:
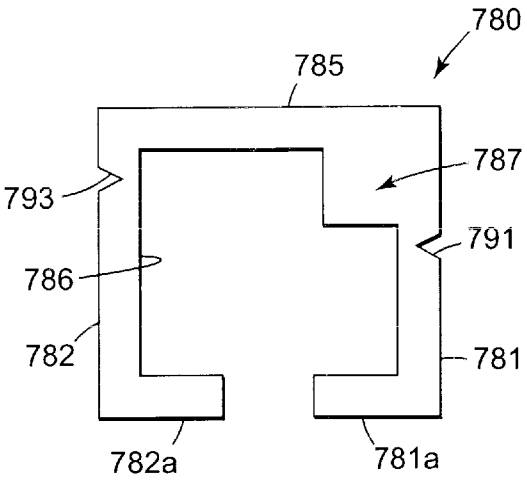
FIG. 10 is an end view of a slider device, according to a further example embodiment of the present disclosure.

Another example of a slider device is shown in FIG. 10 at slider device 780. Slider device 780 has first and second sidewalls 781, 782, and a rigid top wall 785 extending between first and second sidewalls 781, 782, which together define a first cavity 786 that receives the closure profiles (not shown). First sidewall 781 includes a first hooking construction 781*a* and second sidewall 782 includes a second hooking construction 782*a*. Slider device 780 further includes a separating structure 787. Slider device 780 differs from the previous embodiments shown in that first and second sidewalls 781, 782 define notches 791, 793 in their exterior surfaces. First and second notches 791, 793 are designed and constructed to allow first and second sidewalls 781, 782, respectively, to flex outward away from each other during installation of slider device 780 onto resealable closure mechanism 114 (FIG. 1).

The above specification and examples are believed to provide a complete description of the manufacture and use of particular embodiments. Many embodiments can be made.

What is claimed is:

1. A slider device for use with a reclosable package, the slider device comprising:

(a) a top wall;

(b) a first sidewall depending from the top wall and having a first hooking construction;

(c) a second sidewall depending from the top wall and having a second hooking construction;

(i) the top wall, first sidewall, and second sidewall defining a first cavity to operably receive a closure mechanism having first and second selectively engageable closure profiles; and (d) a separating structure to selectively separate the first and second profiles of the closure mechanism; the separating structure including:

(i) a stabilizer extending from the second sidewall and the second hooking construction into the first cavity to retain a lower portion of the second closure profile proximate to a lower portion of the first closure profile; and (ii) a separator depending from the top wall and extending from the first sidewall into the first cavity to apply pressure to an upper portion of the second closure profile to push the upper portion of the second closure profile away from an upper portion of the first closure profile, causing the first and second closure profiles to separate.

2. A slider device according to claim 1 wherein:

(a) the stabilizer includes a first edge extending from the second sidewall and a second edge extending from the second hooking construction, the first and second edges having a first angle therebetween.

3. A slider device according to claim 2 wherein:

(a) the first angle is 90 degrees.

4. A slider device according to claim 1 wherein:

(a) the separator includes a first edge depending from the top wall and a second edge extending from the first sidewall, the first and second edges having a first angle therebetween.

5. A slider device according to claim 4 wherein:

(a) the first angle is 90 degrees.

6. A slider device according to claim 1 wherein:

(a) the second sidewall has a first thickness at a first end and a second thickness at a second end, such that first thickness is greater than the second thickness.

7. A slider device according to claim 1 wherein:

(a) the separator has a first thickness at a first end and a second thickness at a second end, such that the first thickness is greater than the second thickness.

8. A slider device according to claim 1 wherein:

(a) the separator defines a second cavity for receiving the first closure profile.

9. A slider device according to claim 1, further comprising:

(a) a first retention wing extending from the first hooking construction; and (b) a second retention wing extending from the second hooking construction.

10. A slider device according to claim 1, wherein:

(a) the first sidewall defines a first flex notch; and (b) the second sidewall defines a second flex notch.

11. A slider device according to claim 10, wherein:

(a) the first and second flex notches are positioned on the inside of the first and second sidewalls respectively.

12. A closure arrangement for use with a flexible package, the closure arrangement comprising:

(a) a closure mechanism having first and second closure profiles;

(b) a slider device for opening and closing the first and second closure profiles including:

(i) a top wall;

(ii) a first sidewall depending from the top wall and having a first hooking construction;

(iii) a second sidewall depending from the top wall and having a second hooking construction;

(A) the top wall, first sidewall, and second sidewall defining a first cavity to operably receive a closure mechanism having first and second selectively engageable closure profiles; and (iv) a separating structure to selectively separate the first and second profiles of the closure mechanism; the separating structure including:

(A) a stabilizer extending from the second sidewall and the second hooking construction into the first cavity to retain a lower portion of the second closure profile proximate to a lower portion of the first closure profile; and (B) a separator depending from the top wall and extending from the first sidewall into the first cavity to apply pressure to an upper portion of the second closure profile to push the upper portion of the second closure profile away from an upper portion of the first closure profile, causing the first and second closure profiles to separate.

13. A closure arrangement according to claim 12, wherein:

(a) the first closure profile includes first and second interlocking members and a first guide post; and (b) the second closure profile includes first and second interlocking members and a second guide post.

14. A closure arrangement according to claim 12 wherein:

(a) the stabilizer includes a first edge extending from the second sidewall and a second edge extending from the second hooking construction, the first and second edges having a first angle therebetween.

15. A closure arrangement according to claim 12 wherein:

(a) the separator includes a first edge depending from the top wall and a second edge extending from the first sidewall, the first and second edges having a first angle therebetween.

16. A slider device according to claim 12 wherein:

(a) the second sidewall has a first thickness at a first end and a second thickness at a second end, such that first thickness is greater than the second thickness.

17. A slider device according to claim 12 wherein:

(a) the separator has a first thickness at a first end and a second thickness at a second end, such that the first thickness is greater than the second thickness.

18. A slider device according to claim 12 wherein:

(a) the separator defines a second cavity for receiving the first closure profile.

19. A resealable package comprising:

(a) first and second panel sections joined together to define an enclosed region; and a mouth providing access to the enclosed region; and (b) a closure arrangement secured to the first and second panel sections for selectively opening and sealing the mouth; the closure arrangement including:

(i) a closure mechanism including first and second closure profiles secured within the mouth;

(ii) a slider device for opening and closing the first and second closure profiles, the slider device including:

(A) a top wall;

(B) a first sidewall depending from the top wall and having a first hooking construction;

(C) a second sidewall depending from the top wall and having a second hooking construction;

(i) the top wall, first sidewall, and second sidewall defining a first cavity to operably receive the closure mechanism; and (D) a separating structure to selectively separate the first and second profiles of the closure mechanism; the separating structure including:

(i) a stabilizer extending from the second sidewall and the second hooking construction into the first cavity to retain a lower portion of the second closure profile proximate to a lower portion of the first closure profile; and (ii) a separator depending from the top wall and extending from the first sidewall into the first cavity to apply pressure to an upper portion of the second closure profile to push the upper portion of the second closure profile away from an upper portion of the first closure profile, causing the first and second closure profiles to separate.

20. A resealable package according to claim 19, wherein:

(a) the stabilizer includes a first edge extending from the second sidewall and a second edge extending from the second hooking construction, the first and second edges having a first angle therebetween; and (b) the separator includes a first edge depending from the top wall and a second edge extending from the first sidewall, the first and second edges having a first angle therebetween.

21. A method of opening a closure mechanism having first and second closure profiles, the method comprising:

(a) moving a slider device along the closure mechanism in a first direction, wherein the slider device includes first and second sidewalls, a top wall, a separator depending from the top wall and extending from the first sidewall, and a stabilizer extending from the second sidewall, (b) pushing a first portion of the first closure profile away from a first portion of the second closure profile using the separator, (c) retaining a second portion of the first closure profile proximate to a second portion of the second closure profile using the stabilizer during said step of pushing.

* * * * *